United States Patent [19]

Kägi

[11] Patent Number: 5,018,435

[45] Date of Patent: May 28, 1991

[54] FLUID CELL ARRANGEMENT FOR COMPRESSED AIR MOTORS

[75] Inventor: René Kägi, Stäfa, Switzerland

[73] Assignees: Riwisa AG Kunststoffwerke, Hagglingen; Bruno P. Wernli, Habsburg; Gerold Richner, Wohlen; Peter Richner, Hagglingen, all of Switzerland

[21] Appl. No.: 418,166

[22] Filed: Oct. 6, 1989

[30] Foreign Application Priority Data

Jul. 5, 1989 [CH] Switzerland ..... 02491/89

[51] Int. Cl.[5] ..... F01B 19/00; F01B 3/00; F01B 13/04

[52] U.S. Cl. ..... 92/48; 92/71; 92/92; 91/499; 192/88 A

[58] Field of Search ..... 92/72, 89, 90, 91, 92, 92/93, 48; 192/88 A, 88 B, 88 R; 91/59, 499, 500

[56] References Cited

U.S. PATENT DOCUMENTS

| | | | |
|---|---|---|---|
| 1,018,412 | 2/1912 | Diesel | 192/88 A |
| 2,439,849 | 4/1948 | Fawick | 192/88 A |
| 2,688,983 | 9/1954 | Bowerman | 92/92 |
| 3,004,559 | 10/1961 | Warman, Jr. | 192/88 A |
| 3,963,386 | 6/1976 | Hirmann | 92/92 |
| 3,973,471 | 8/1976 | Hirmann | 92/92 |
| 3,998,130 | 12/1976 | Hirmann | 417/295 |

FOREIGN PATENT DOCUMENTS

| | | | |
|---|---|---|---|
| 2351990 | 5/1974 | Fed. Rep. of Germany | 92/90 |
| 2047344 | 11/1980 | United Kingdom | 92/90 |

*Primary Examiner*—John T. Kwon
*Assistant Examiner*—Thomas Denion
*Attorney, Agent, or Firm*—Herbert Dubno

[57] ABSTRACT

Fluid cell arrangement for compressed air radial motors, comprising a plurality of fluid cells arranged rosette-shaped to one another in a pressureless state and approximately plane for the alternate inflation of fluid cells, which are provided with air connector means and which are formed by welding two leaves of film or foil made of synthetic resin along the peripheries of the cells. In this connection, an endless elastic rubber cord or ring inserted between the two film leaves extends along the peripheries of the cells and is disposed in radial arrangement near the center of rotation, the two film leaves made of synthetic resin being disposed on both sides of the ring and completely enclosing the latter are welded together.

4 Claims, 1 Drawing Sheet

FLUID CELL ARRANGEMENT FOR COMPRESSED AIR MOTORS

FIELD OF THE INVENTION

The present invention relates to a fluid cell arrangement for compressed air radial motors comprising a plurality of fluid cells arranged rosette-shaped to one another in a pressureless state and approximately in a plane for the alternate inflation of fluid cells provided with air connecting means and which are formed by welding two leaves of film or foil made of a synthetic resin along the peripheries of the cells.

BACKGROUND OF THE INVENTION

From U.S. Pat. No. 3,998,130, a fluid cell arrangement of the aforementioned kind has already been made known which is made from tension-proof leaves of film or foil of synthetic resin and which are connected by welding to form a bag. These cells are made with either a circular, disc-shaped design, or show a design with the edge thereof being formed by alternate convex and concave parts or areas. If, as is in the first case, the fluid cells are formed by using two circular disc-shaped film leaves welded along the circumference thereof, then the advantage of a simple tool fabrication for the film leaves presents itself However, in regard to the film tension encountered in the different lifting layers, it has been found to be problematic. The reason therefore are the tangential pressure force arising due to the functionally-dependent shortening of the circumferential length, which, from a critical height of lift, causes a bending-in on the edge of the cell in relation to the seam areas, and which decreases the longevity of the cell considerably. In order to counteract this, fluid cells according to the second-mentioned method of construction have been designed, whereby the tangential pressure force arising in the edge parts is at least partially eliminated by a tangential traction on the convex circumferential parts. However, also this has not led to satisfactory results. Thus, such fluid cells for compressed air radial motors have never succeeded in being generally adopted in spite of the many excellent qualities thereof.

OBJECTS OF THE INVENTION

Therefore, a primary object of the present invention is to provide a fluid cell of the aforementioned kind in such a manner that it will have several times the efficiency and durability of prior constructions, which permits most favorable results on a compressed air radial motor in regard to starting, high moment of rotation, maximum performance, rotational speed independent of load, and the like.

SUMMARY OF THE INVENTION

This is achieved according to the invention in that an endless elastic rubber cord or ring inserted between the two film leaves extends along the peripheries of the cells and is disposed in radial arrangement near the center of rotation, the two film leaves being made of synthetic resin and disposed on both sides of the ring to completely enclose the latter and being welded together.

As a result of these steps, each individual cell is quasi reinforced all around by the elastic rubber ring taking up practically all hithereto effective peripheral forces. This gives the best possible bag behavior of the cell, with which durability and efficiency of a hitherto unexpected order of magnitude is attained. Moreover, the fluid cell arrangement according to the invention may easily be mass produced and therefore available to the user in any desired number.

In addition, the radial elevations found situated near the center of rotation and brought about by the elastic rubber ring, constitute means forming a form-locking driving connection.

Accordingly, the present invention further relates to the utilization of the fluid cell arrangement in a compressed air radial motor with a rotating, flat supporting disc and a conical supporting disc carried by the driving shaft, between which the fluid cell arrangement is disposed.

In accordance with the invention, the radial elevations of the fluid cell arrangement situated near the center of rotation and brought about by the elastic rubber cord or ring are sunk in appropriate grooves in the face side of the flat supporting disc in order to produce a form-locking, torque driving connection.

Due to this, it is hence unnecessary to cement the fluid cell arrangement onto the flat supporting disc, as was heretofore the case, which permits a replacement of the fluid cell arrangement at any time and without effort.

BRIEF DESCRIPTION OF THE DRAWING

Embodiments of the invention will now be described more particularly with reference to the accompanying drawing, wherein.

SPECIFIC DESCRIPTION

Figure 1:
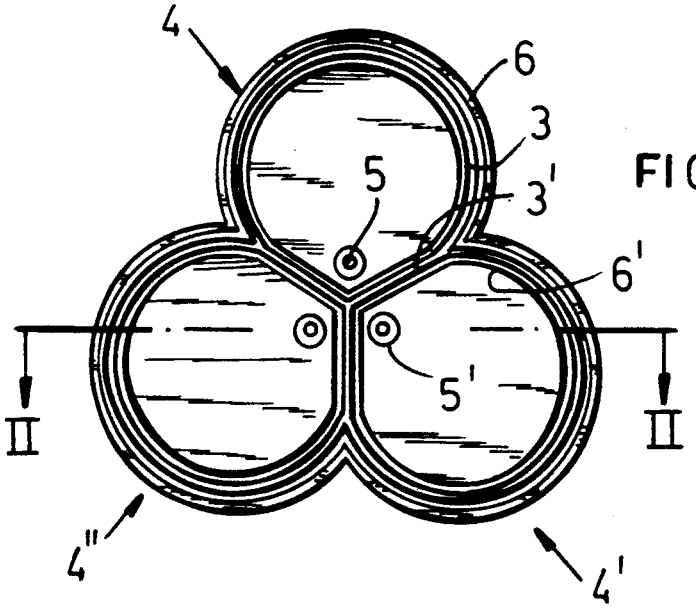
FIG. 1 is a plan view and schematic representation of a fluid cell arrangement according to the invention.
Figure 2:
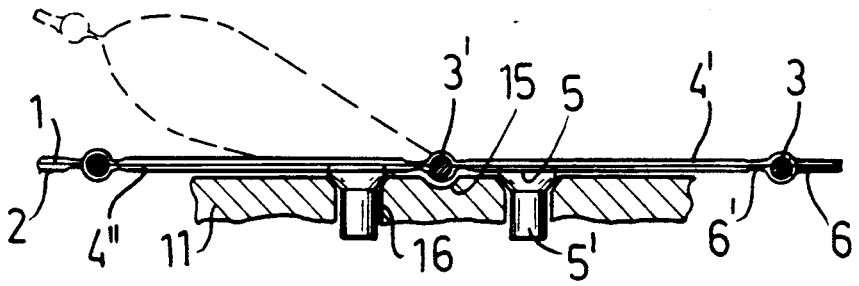
FIG. 2 is a section taken along the line II—II in FIG. 1.

The fluid cell arrangement according to FIGS. 1 and has, for example, three fluid cells in a rosette-shape pattern in a pressureless state and approximately in a plane for the alternate inflation of fluid cells 4,4',4'', which are provided with air connecting means 5,5' and which are formed by welding two leaves of film or foil 1 and 2 made of synthetic resin along the peripheries of the cells.

Thus far, such fluid cell arrangements are known. The number and radial expansion of the cells can vary, of course.

Essential to the invention is that an endless elastic rubber cord or ring 3 inserted between the two film leaves 1 and 2 extends along the peripheries of the cells and is disposed in radial arrangement near the center of rotation. The two film leaves 1 and 2 made of synthetic resin disposed on opposite sides of the ring 3 and completely enclosing the latter are welded together, as is indicated by the weld lines 6,6'.

The cross-section of the ring 3 is optional. Preferably, the ring can be manufactured by punching-out, which results in a rectangular cross-section. The capacity of the ring to withstand the forces on the cells is not affected.

It is important that the radial elevations 3' positioned near the center of rotation and brought about by the elastic rubber ring 3, constitute means forming a form-locking driving connection, as will be described in detail below.

Figure 3:
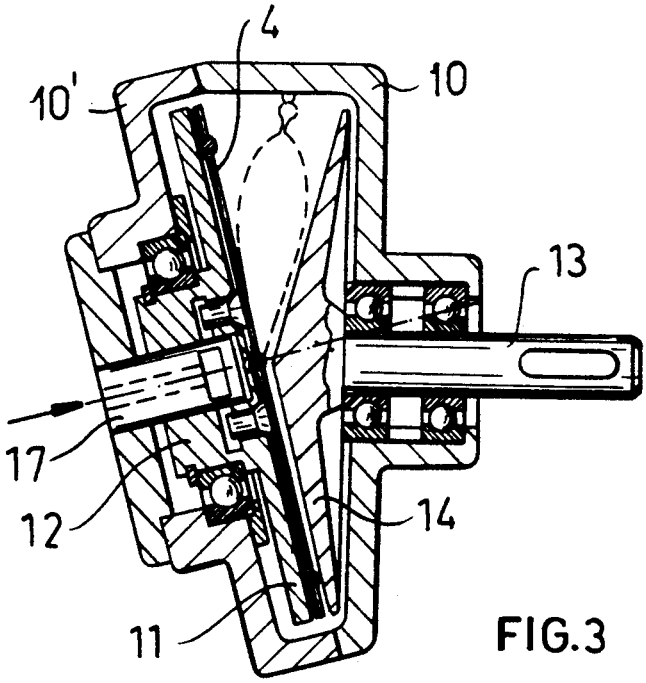
FIG. 3 is a sectional representation of a compressed air radial motor with a fluid cell arrangement according to FIGS. 1 and 2.

As FIG. 3 diagrammatically illustrates, the compressed air radial motor comprises two housing sections 10,10', which as a rule may be easily separated from each other, in the chamber thereof a rotating, flat supporting disc 11 extends, the axis of rotation thereof forming, with a driving shaft 13, a corresponding angle of the conicalness of a conical supporting disc 14 connected to the driving shaft 13.

The fluid cell arrangement according to the invention is supported on the flat supporting disc 11, the radial elevations 3' of the fluid cell arrangement positioned near the centre of rotation and brought about by the elastic rubber cord or ring 3 being sunk in corresponding grooves 15 in the face side of the flat supporting disc 11, which ensures a radially-enlarged, form-locking torque driving connection between the fluid cell arrangement and flat supporting disc 11. In addition, the air connector sockets 5' sit in corresponding connector boreholes 16 in the supporting disc 11 and are interconnected via the feed duct 17 to a pressure source (not shown).

As a result, it is unnecessary to cement the fluid cell arrangement onto the flat supporting disc, as was heretofore the case, which permits a replacement of the fluid cell arrangement at any time and without effort.

The fluid cell arrangement is, moreover, only in operative connection to the conical supporting disc 14.

The operating characteristics of such compressed air motors are known. In order to put the motor into operation, pressure medium, for instance compressed air, is supplied through the feed duct 17. The pressure medium enters the fluid cell which has momentarily arrived and which has increased in volume. In this way, in consequence of the described arrangement of the two supporting discs 11 and 14, there results a torque on the conical supporting disc 14, which is proportional to the pressure. As a consequence, the conical supporting disc 14 rotates together with the flat supporting disc 11.

While there are shown and described preferred embodiments of the invention, it is to be distinctly understood that the invention is not limited thereto but may be embodied and practised within the scope of the following claims.

What I claim is:

1. A fluid cell arrangement for compressed air radial motors, comprising:

a plurality of fluid cells arranged in a rosette-shape in a pressureless state and approximately in a plane for the alternate inflation and deflation of said fluid cells said cells being defined by a pair of leaves of synthetic resin;

an endless elastic rubber cord received between the two film leaves and extend along the peripheries of the cells and extending radially near a center of rotation of the cells, the two film leaves made of synthetic resin being disposed on both sides of the rubber cord, completely enclosing the rubber cord and being welded together to form radial elevations near the center of rotation to provide a form-locking driving connection for driving of a plate engageable with said cells.

2. The fluid cell arrangement as defined in claim 1 utilized in a compressed air radial motor, further comprising a driving shaft, a rotating, flat supporting disk and a conical supporting disk carried by the driving shaft, said cells being located between said disks, the radial elevations arrangement near the center of rotation being received in respective grooves in a face side of the flat supporting disk in order to produce a form-locking, torque driving connection between said disks and said cells.

3. A fluid cell arrangement for a compressed air radial motor, said arrangement having a center and comprising:

a plurality of fluid cells arranged in a rosette-shape pattern, said fluid cells being planar in a pressureless state thereof, said cells being defined by a pair of leaves of a synthetic resin film welded to one another along peripheries of the cells and defining a respective freely distortable chamber within the periphery of each cell;

means for conducting an inflating medium into each of said chambers; and an endless elastic rubber cord extending along peripheries of said cells and received between the pair of leaves, said rubber cord being disposed radially with respect to a center of the cell arrangement proximal to said center and being completed enclosed by said pairs of leaves sealing said rubber cord therebetween.

4. A compressed air radial motor comprising:

a housing;

an output driving shaft mounted on said housing and rotatable about a first axis;

a conical supporting disk mounted on said driving shaft and rotatable about said first axis;

a flat supporting disk mounted on said housing and rotatable about another axis inclined said first axis, said supporting disk being formed with an inner side facing said conical disk spaced from said flat disk, said flat disk having a center; and a fluid cell arrangement between said disks and including:

a plurality of fluid cells arranged rosette-shaped to one another, said cells being formed between a pair of leaves of a synthetic resin film welded to one another along peripheries of the respective cell and forming respective chambers within the peripheries, means for conducting an inflating medium into each of said chambers being expanded upon filling thereof with said inflating medium, and an endless elastic rubber cord extending along said peripheries of said cells and inserted between said leaves, said rubber cord being disposed radially with respect to said center and forming respective elevations lying radially of said center, said inner side of the flat disk being formed with grooves receiving said elevations and forming therewith means for forming-locking driving.

* * * * *